US007114203B2

(12) United States Patent
Lloyd et al.

(10) Patent No.: US 7,114,203 B2
(45) Date of Patent: Oct. 3, 2006

(54) LATERAL TRANSFER ACCESSORY

(75) Inventors: John Derek Lloyd, San Antonio, FL (US); Stuart Wilkinson, Zephyrhills, FL (US)

(73) Assignee: The United States of America as represented by the Department of Veterans Affairs, Washington, DC (US)

( * ) Notice: Subject to any disclaimer, the term of this patent is extended or adjusted under 35 U.S.C. 154(b) by 10 days.

(21) Appl. No.: 11/017,208

(22) Filed: Dec. 21, 2004

(65) Prior Publication Data

US 2005/0150045 A1 Jul. 14, 2005

Related U.S. Application Data

(60) Provisional application No. 60/534,365, filed on Jan. 6, 2004.

(51) Int. Cl.
*A61G 7/10* (2006.01)

(52) U.S. Cl. ..... 5/81.1 HS; 5/81.1 R

(58) Field of Classification Search ..... 5/81.1 R, 5/85.1, 88.1, 89.1, 81.1 HS
See application file for complete search history.

(56) References Cited

U.S. PATENT DOCUMENTS

| | | | | |
|---|---|---|---|---|
| 2,665,432 | A | 1/1954 | Butler | |
| 4,868,938 | A | 9/1989 | Knouse | |
| 5,544,371 | A * | 8/1996 | Fuller | 5/85.1 |
| 5,737,781 | A | 4/1998 | Votel | |
| D402,434 | S | 12/1998 | Votel | |
| 5,890,238 | A | 4/1999 | Votel | |
| 5,901,388 | A | 5/1999 | Cowan | |
| 6,289,533 | B1 | 9/2001 | Hodgetts | |
| 6,341,393 | B1 | 1/2002 | Votel | |
| 6,378,148 | B1 | 4/2002 | Votel | |
| 6,496,991 | B1 | 12/2002 | Votel | |
| 6,615,423 | B1 | 9/2003 | Sverdlik et al. | |
| 2003/0074732 | A1 | 4/2003 | Hanson et al. | |
| 2003/0110559 | A1 | 6/2003 | Weigand | |

* cited by examiner

*Primary Examiner*—Patricia L. Engle
*Assistant Examiner*—Fredrick Conley
(74) *Attorney, Agent, or Firm*—Dykema Gossett PLLC

(57) ABSTRACT

A lateral transfer accessory (LTA) expands the capabilities of overhead ceiling lifts(OCLs). The accessory includes passive mechanical components requiring no electrical power supply or batteries. The accessory is powered by the OCL. In a particular embodiment, the LTA is a mobile unit positioned adjacent to the side of a patient's bed or gurney. A pair of releasable patient draw straps are secured to and coiled around patient draw pulleys. The free ends of the draw straps are attached to the draw sheet beneath the patient. A drive pulley carries a drive strap. The drive strap is secured to the pull strap of the overhead ceiling lift (OCL) positioned over the accessory. The OCL is controlled to draw out the drive strap from the accessory to thereby operate the main drive. The main drive, in turn, actuates the patient draw pulley to retract the patient draw straps attached to the draw sheet and thereby laterally transfer the patient. In an alternative embodiments the LTA is height adjustable; has a manual actuator for the drive; and includes a drive assembly with a transmission or a simplified drive assembly with a direct drive.

16 Claims, 7 Drawing Sheets

LATERAL TRANSFER ACCESSORY

CROSS REFERENCE TO RELATED APPLICATION

This application is related to U.S. Provisional Application Ser. No. 60/534,365, filed Jan. 6, 2004, the teachings of which are incorporated herein by reference.

BACKGROUND OF THE INVENTION

The invention pertains to a method and apparatus for transferring a patient between two adjacent horizontal surfaces, such as between a hospital bed and a gurney. In particular, the invention employs mechanical system adapted to be powered by an overhead ceiling lift available in most hospitals and long term care facilities.

The lateral transfer of severely physically challenged patients between two horizontal surfaces, is common practice in hospitals and long term care facilities. To accomplish such a transfer without the aid of some assistance device can result in injury to the caregiver and/or patient. Accordingly, a number of products have become available to aid in this operation. In each case a sheet positioned beneath the patient is grasped and pulled. Typically the sheet is pulled by straps wrapped around some form of horizontal roller or pulley system. Mechanical advantage is afforded by a reduction mechanism driven manually by a crank or electrically by an motor. Motor driven systems are superior, in that they require minimal physical exertion by the caregiver, while providing smooth and therefore less stressful motion of the patient. However, motorized systems are expensive because each requires a motor and control components. This can be prohibitively expensive, particularly because it is often necessary to purchase a number of units to insure that the equipment is close at hand when needed.

Hospitals and long term care facilities have already made a considerable investment of limited resources in motorized overhead ceiling lifts (OCLs). These are devices that can assist caregivers with a multitude of patient handling tasks. Accordingly, an effort has been made to make these widely available. Although OCLs are designed only for vertical lift, and aerial translation of patients, they do already include an electric motor, a reduction mechanism, and controls which represent expensive components in a powered lateral transfer assistance device. The invention herein seeks to expand the capabilities of an OCL by means of an accessory to allow motorized lateral transfer of patients. The accessory may be made cost effective, thereby encouraging widespread use.

SUMMARY OF THE INVENTION

The invention is based on the discovery that a lateral transfer accessory (LTA) may be made available to expand the capabilities of overhead ceiling lifts (OCLs). The accessory or device may include only passive mechanical components requiring no electrical power supply or batteries. The accessory may be powered by the OCL.

In a particular embodiment, the LTA is a mobile unit that may be positioned adjacent to the side of a patient's bed or gurney. The accessory has a pair of releasable patient draw straps each of which are secured to and coiled at a proximate end around a patient draw pulley. The patient draw straps may be manually withdrawn from the side of the LTA adjacent the bed, and the free ends thereof may be attached to the draw sheet beneath the patient. The patient draw pulley is carried by a shaft mounted main drive which includes a clutch to release the patient draw pulley, thereby allowing the strap to be withdrawn from the LTA. To facilitate horizontal transfer each strap is pulled with a force of about 150 pounds over a distance of about 36" by rotation of the corresponding patient draw pulley.

The main drive is coupled to a drive pulley which carries a drive strap. The drive strap is secured at its proximate end to and wrapped around the drive pulley. The drive strap may then be secured to the pull strap of an overhead ceiling lift (OCL) positioned over the accessory. The OCL is controlled in a conventional way to retract and pull or draw out the drive strap from the accessory to thereby operate the main drive. The main drive, in turn, actuates the patient draw pulley to retract the patient draw straps attached to the draw sheet and thereby laterally transfer the patient.

In alternative embodiments, the LTA may be height adjustable for engaging various bed and gurney arrangements; the LTA may have a manual crank; and the LTA may have a simplified drive system.

DESCRIPTION OF THE INVENTION

Figure 1:
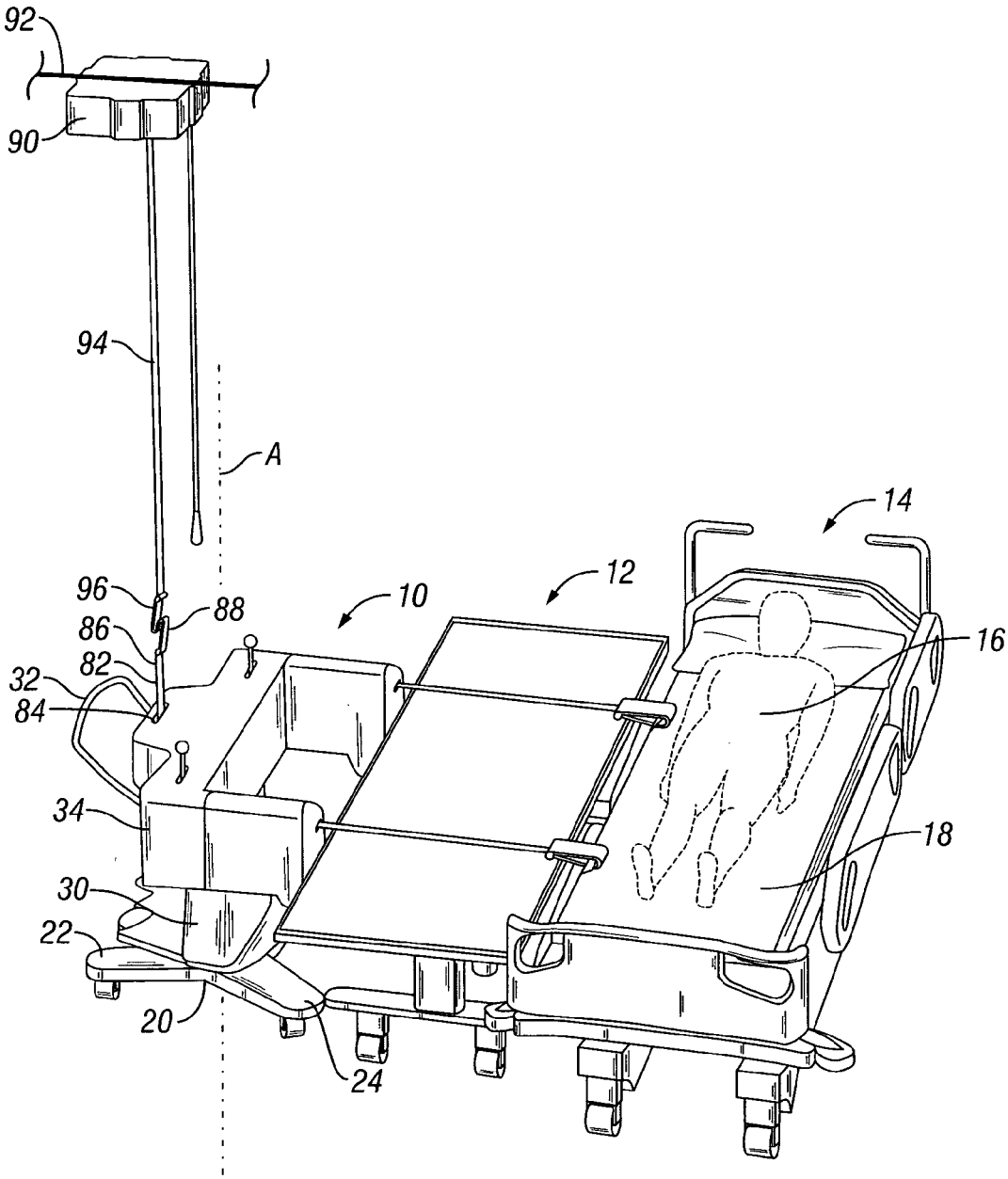
FIG. 1 is a front perspective view of an LTA according to the invention being positioned adjacent to a gurney, bed, or other horizontal surface from which the patient is to be transferred.
Figure 2:
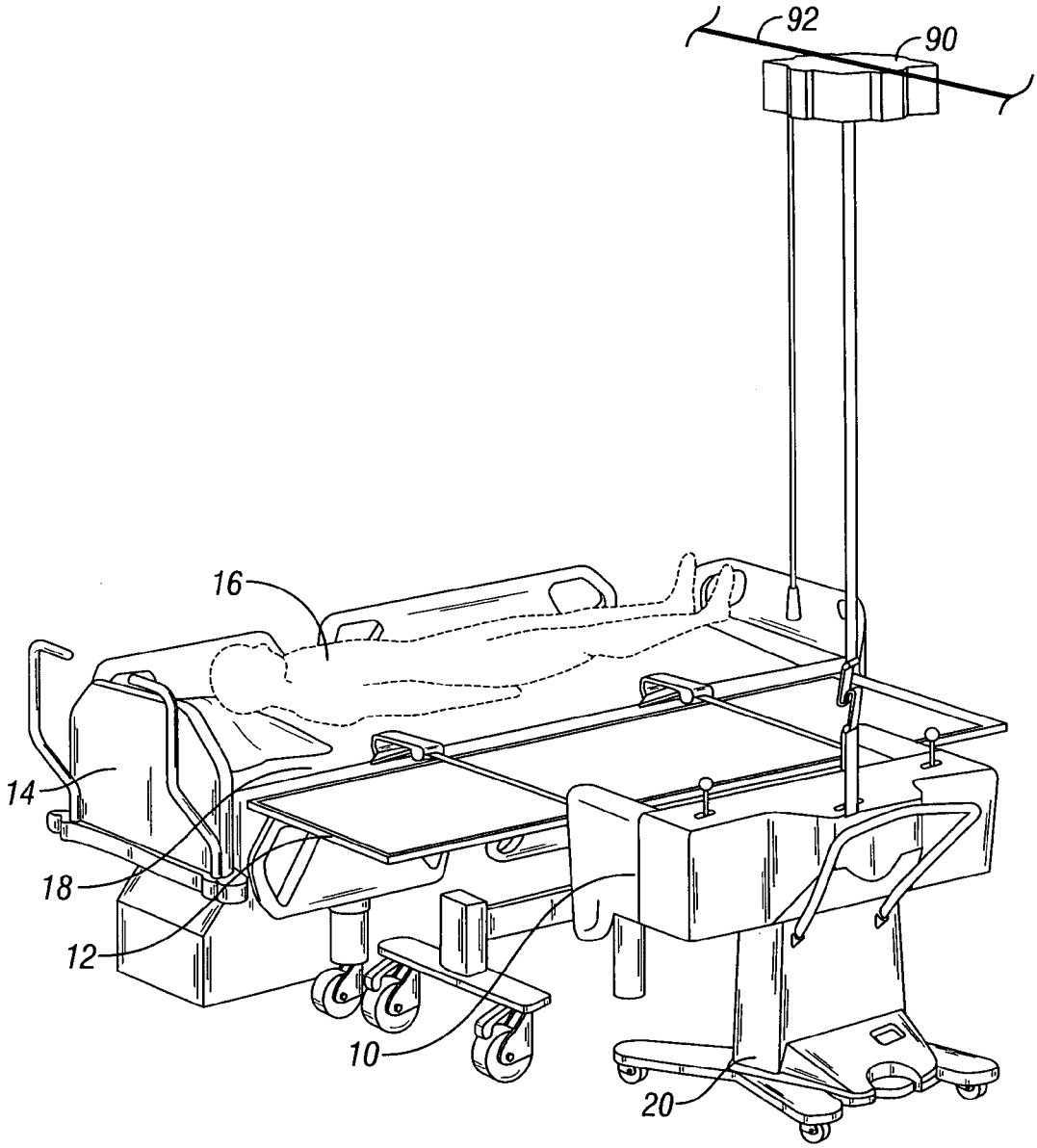
FIG. 2 is a rear perspective view of the arrangement shown in FIG. 1.
Figure 3:
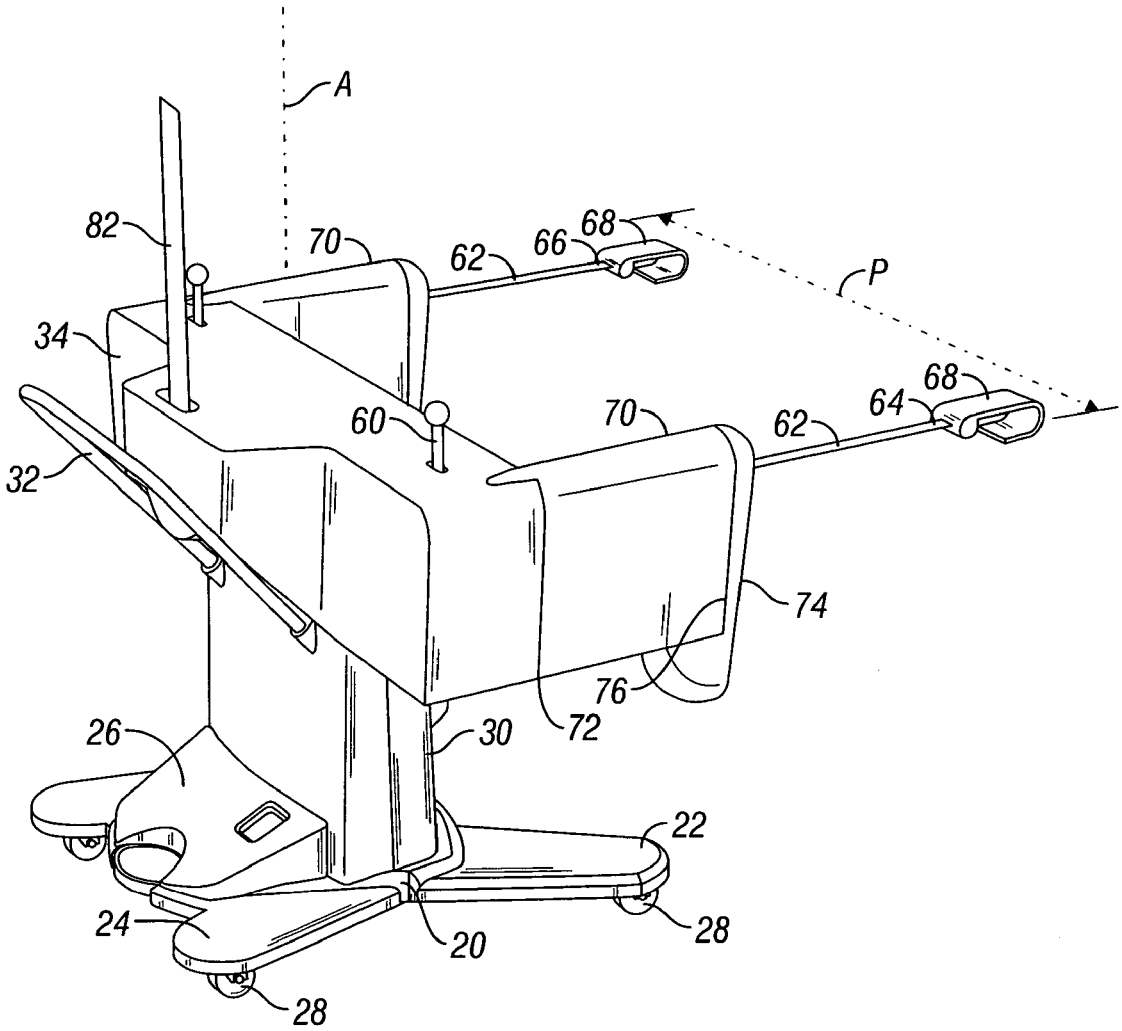
FIG. 3 is a rear perspective view of the LTA shown in FIG. 1.
Figure 4:
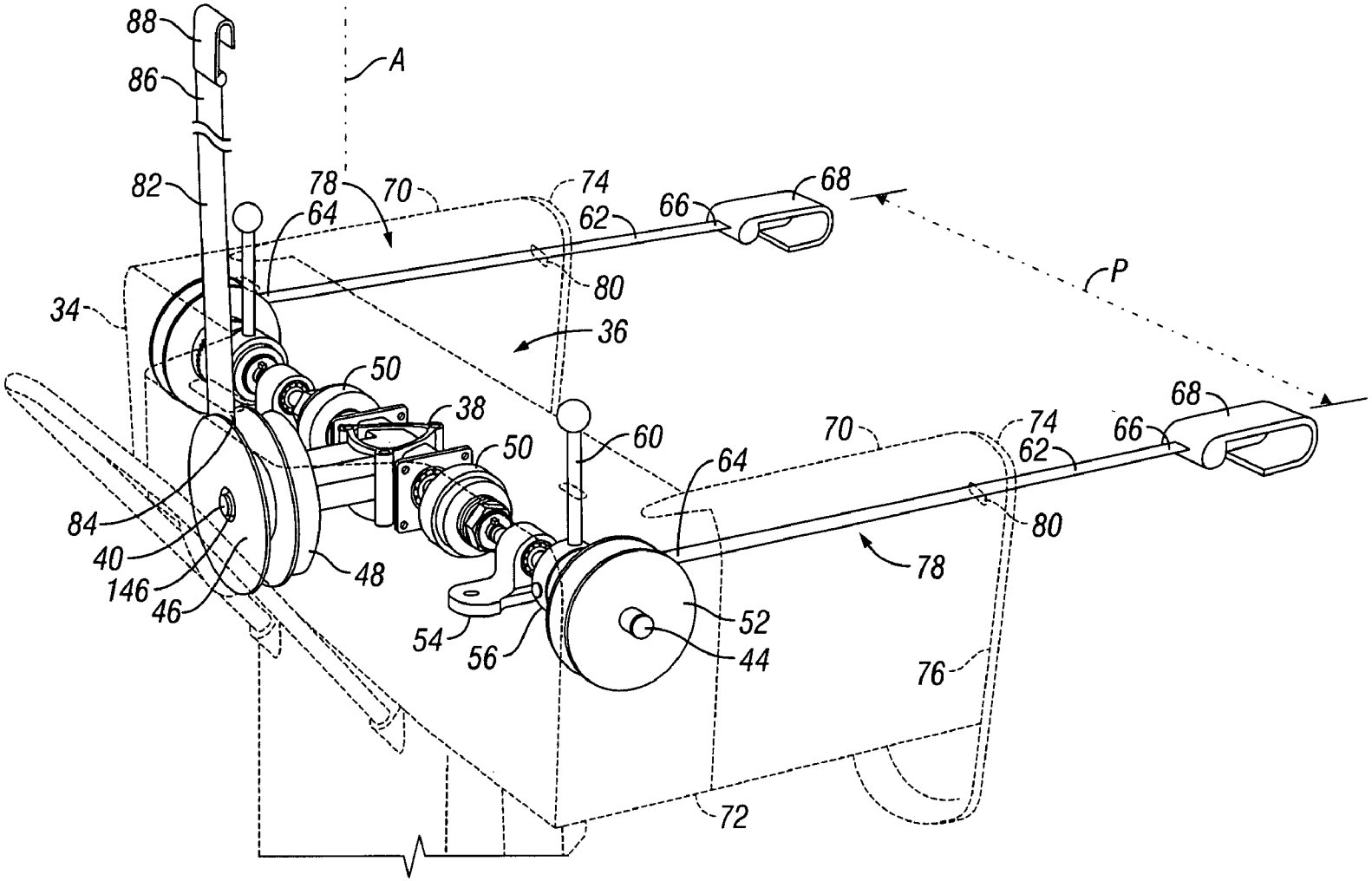
FIG. 4 is a perspective view of a drive system for the LTA according to the invention with the housing shown in dotted line.

FIGS. 1–4 show a lateral transfer accessory (LTA) 10 in accordance with the invention. The LTA 10 is positioned adjacent to a gurney 12. The gurney, in turn, is positioned adjacent to the side of a bed 14 occupied by a patient 16 lying atop a standard draw sheet 18. The LTA 10 has a base 20, having a central vertical axis A, front and rear legs 22 and 24, and a ballasted portion 26 disposed on the base above the rear legs 24. The base is mounted for movement about the floor by means of lockable casters 28. The front and rear legs 22 and 24 extend radially from the base to establish a stable footprint for the LTA 10. A central column 30 is mounted atop the base 20 as shown. Pull handle 32 is secured to the rear of the column 30 which allows an operator to position the LTA as required. A drive housing 34 is mounted atop the column 30. The drive housing 34 houses a drive system 36, shown in the perspective view of FIG. 4.

The drive system 36 comprises a transmission (not shown) secured in a housing 38. The transmission has an input shaft 40 and a pair of output shafts 44 extending laterally therefrom. The input shaft 40 has a main drive pulley 46 and strap retractor 48 mounted thereon via a one-way bearing 146 as shown. The output shafts 44 each have a slip clutch 50, a manually releasable clutch 56 and a patient draw pulley 52 secured thereto. The slip clutches 50 act as automatic torque limiters, thereby protecting both the patient and drive system from overload conditions. The output shafts 44 are secured in the drive housing 34 by means of roller bearings 54. The transmission includes a gear set (not shown) for coupling drive power from the drive pulley 46 to the patient draw pulleys 52. The patient draw pulleys 52 may be manually disengaged from the output shafts 44 by corresponding manual clutch lever 60.

Patient draw straps 62, each having a corresponding proximal end 64, are secured to and wrapped around a corresponding one of the patient draw pulleys 52. The free end 66 of each patient draw strap 62 has a draw hook 68 secured thereto for engaging the draw sheet 18 as hereinafter described.

Spacer arms 70 extend from the front of the drive housing 34 for engaging the bed, gurney or other horizontal transfer surface 14. The spacer arms 70, each of which has a distal end 72, extend outwardly from the base 30, as shown; and each distal end 72 is positioned, more or less, above the front legs 22. Pads 74 are secured to the front side 76 of the spacer arms 70 to allow them to softly engage the bed or gurney 14 or 12. The spacer arms 70 are hollow, forming a passage 78 therein. The ends 72 and the arms 70 have aligned openings 80 for allowing the patient draw straps 62 to extend therethrough. The patient draw straps 62 may be extended by manually pulling each draw hook 68 outwardly from the spacer arms 70 when the clutches 56 are manually released. In use, the draw straps extend from the spacer arms 70 in plane P parallel to the top of the gurney 12 and perpendicular to the central axis A.

A drive strap 82 has a proximal end 84 secured to and wrapped around the drive pulley 46. The distal end 86 of the drive strap 82 has a drive hook 88 adapted to engage an overhead ceiling lift (OCL) 90. The particulars of OCLs are not described in detail herein because there are many such devices in use. [v1]It is sufficient for this discussion to note that the OCL 90 is mounted on a ceiling mounted track 92 and is selectively positionable about the patient area so that the patient may be lifted vertically and transported. The OCL 90 is separately powered and controlled so that when it is used with the lateral transfer accessory 10 of the invention, the LTA is driven by power supplied by the OCL and does not require a separate or dedicated source of motive power.

The OCL 90 has a pull strap 94 having a pull hook 96 for engaging the drive hook 88 at the end of the drive strap 82. When the OCL 90 is operated the pull strap 94 may be raised or lowered by the operator. In accordance with the invention, the pull strap 94 is lowered into position, and the pull hook 96 is attached to the draw hook 88. The OCL 90 is then operated to retract or draw the pull strap 94 upwardly for drawing the drive strap 82 outwardly of the drive housing 34 generally parallel to the central axis A. The drive pulley 46 rotates causing the drive strap 82 to actuate, in turn, the input shaft 40, the transmission 38, the output shafts 44 and patient draw pulleys 52 to thereby retract the patient draw straps 62 secured to the draw sheet 18 into the LTA 10. As a result, the patient 16 is laterally transferred from the bed 14 to the gurney 12.

The drive pulley 46 is mounted on the shaft 40 via a one-way bearing 146 and retractor 48 which is a spring loaded reel adapted or biased to a rest position in order to retract or rewind the drive strap 82 when the drive strap is released. After the patient 16 is transferred, the user operates the OCL 90 to lower pull strap 94. The drive hook 88 is manually released from the pull hook 96 and the retractor 48 rewinds the drive strap 82 around the drive pulley 46.

When the patient is safely secured to the gurney, the LTA 10 may be disengaged from the draw sheet 18 and OCL 90, and thereafter removed from service.

Figure 5:
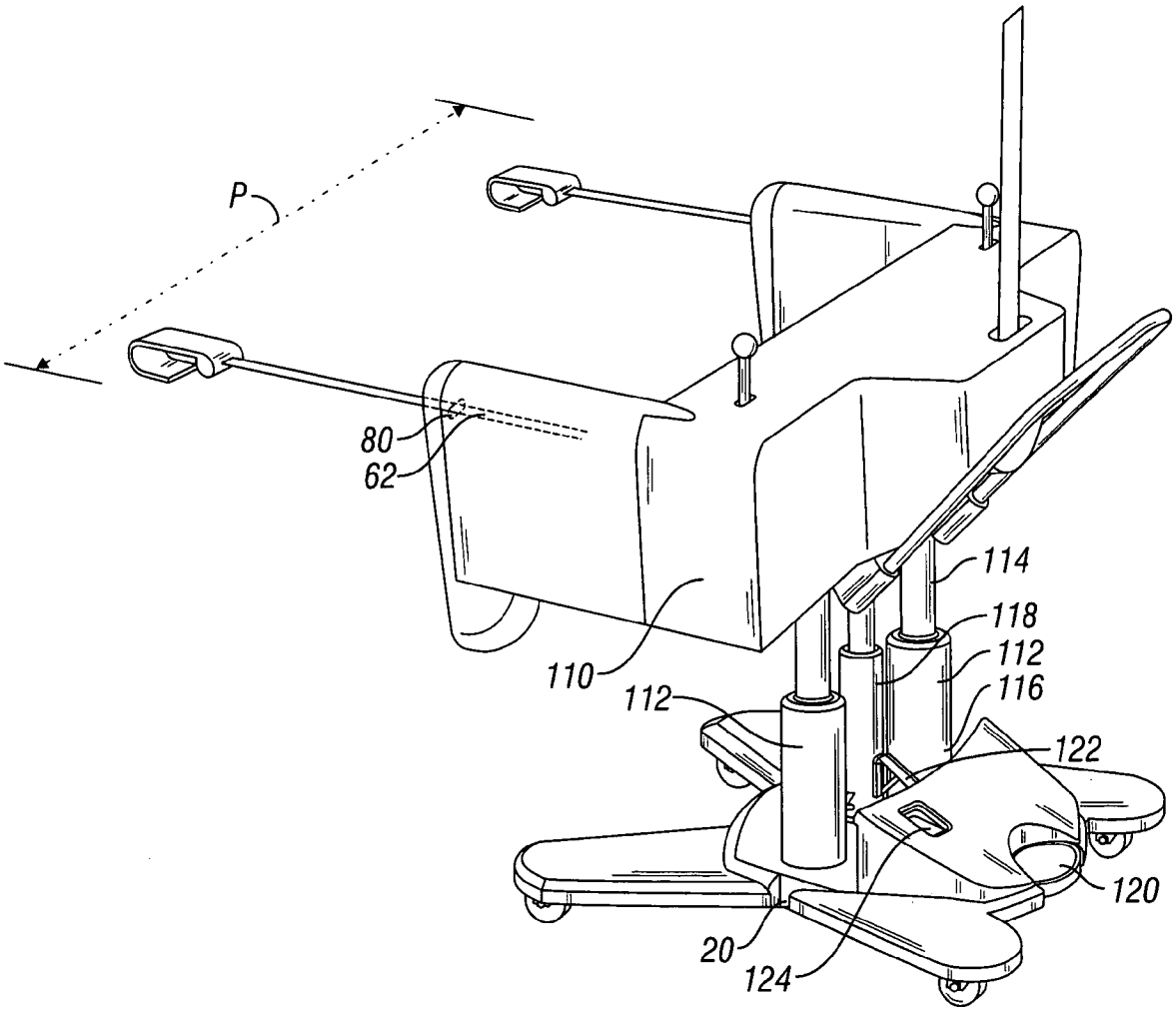
FIG. 5 is a rear perspective view of an alternative embodiment of the invention employing a height adjustment.

The embodiment illustrated in FIG. 5, where similar elements have the same reference numerals as in FIGS. 1–4, employs a height adjustable drive housing 110 secured to the base 20 by a pair of telescopic central columns 112. Each column 112 has an upper end 114 secured to the drive housing 34 and a lower end 116 secured to the base 20. A hydraulic cylinder 118 operated by a foot actuated pedal 120 coupled to the cylinder 118 by linkage 122 is secured between the base 20 and the drive housing 110. The cylinder 118 is adapted to expand when the foot actuated pedal 120 is manually actuated by the operator for lifting the drive housing upwardly. A foot actuated release pedal 124 is coupled to the cylinder 118 by the linkage 122, and is manually operable to release the cylinder 118 and thereby lower the column 112.

The hydraulic cylinder 118 may thus be raised or lowered in order to position the openings 80 in the spacers 70, more or less level with the top of the gurney, so that when the draw straps 62 are pulled out of the drive housing 34, and attached to the draw sheet, the draw straps 62 and the openings 80 are more or less aligned parallel with the top of the gurney 12 in the plane P. This arrangement facilitates stable operation of the transfer device so that the draw straps are not pulling in an upward direction, if the openings 80 in the drive housing are above the top of the gurney 12; and likewise avoids excessive contact between the draw straps 62 and the top of the gurney 12, if the openings 80 in the drive housing are below the top of the gurney 12.

Figure 6:
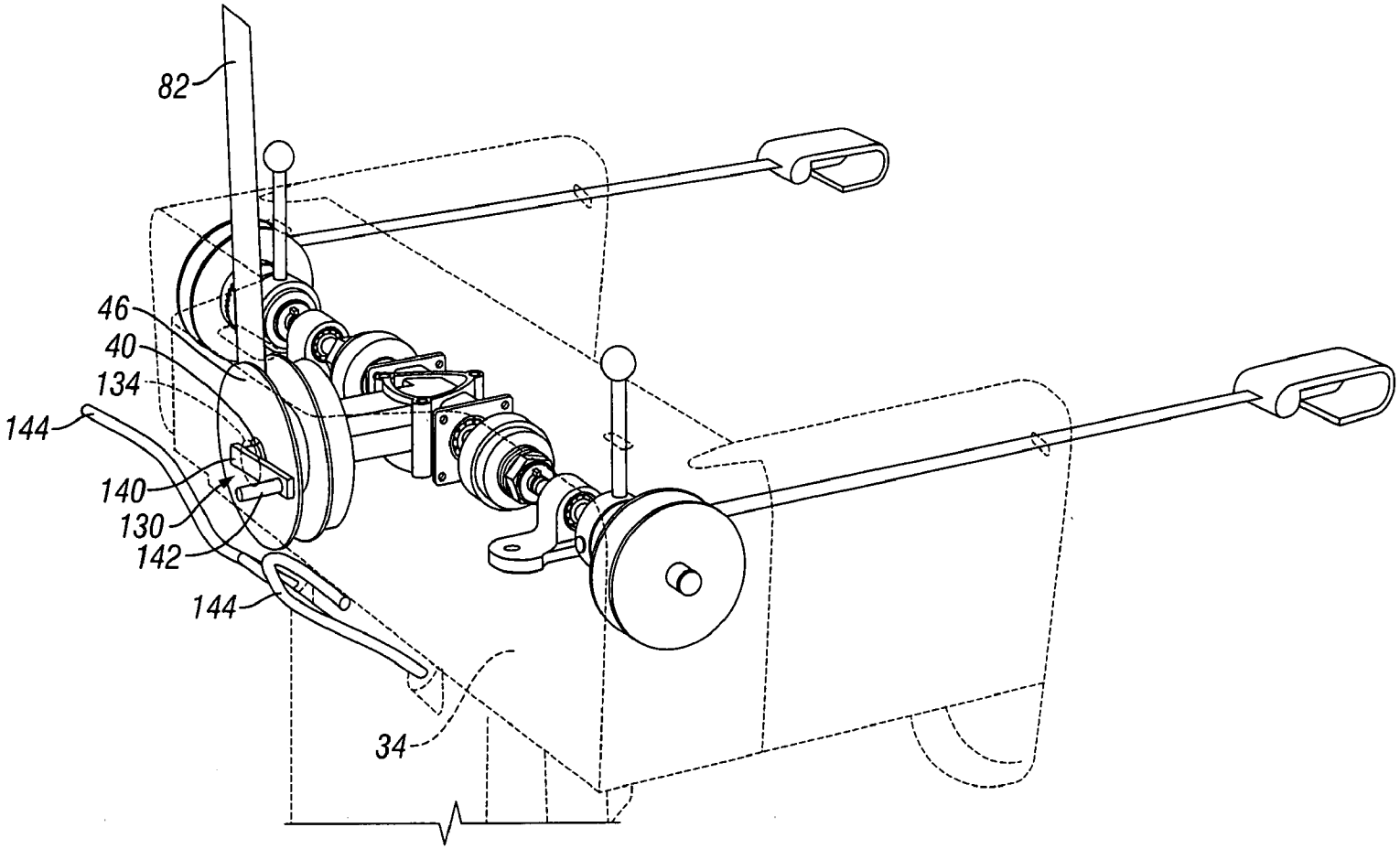
FIG. 6 is a fragmentary illustration of an alternative embodiment employing a manual crank.

The LTA 10 employs the overhead ceiling lift to provide powered actuation. However the functionality of the LTA 10 can be expanded to areas that lack a ceiling lift by the addition of a manual crank 130 at the input. (FIG. 6) The manual crank 130 is attached to the input shaft 40 of the transmission 38 through an opening 134 in the upper housing 34. The crank comprises a lever arm 140 and swivel handle 142.

The typical powered ceiling lift 90 provides an initial upward force of about 75 pounds. The input strap 82, which is attached to pulley 46, has a radius of 1". This corresponds to an input torque of 75 Lbf-in. For manual operation the same torque must be provided via the crank. It is assumed that greatest force that an operator can be expected to exert on a crank is 15 Lbf. Accordingly, the lever arm must have a minimum length of 5 inches. In order to accommodate the 10" diameter or swing radius of the crank 130, the LTA is equipped with a modified reshaped and repositioned push bar 144 as shown. The existing one-way bearing 146 in the input pulley hub will result in the input pulley 46 remaining static or isolated during manual cranking, such that no further design changes are needed when the manual feature is employed.

Figure 7:
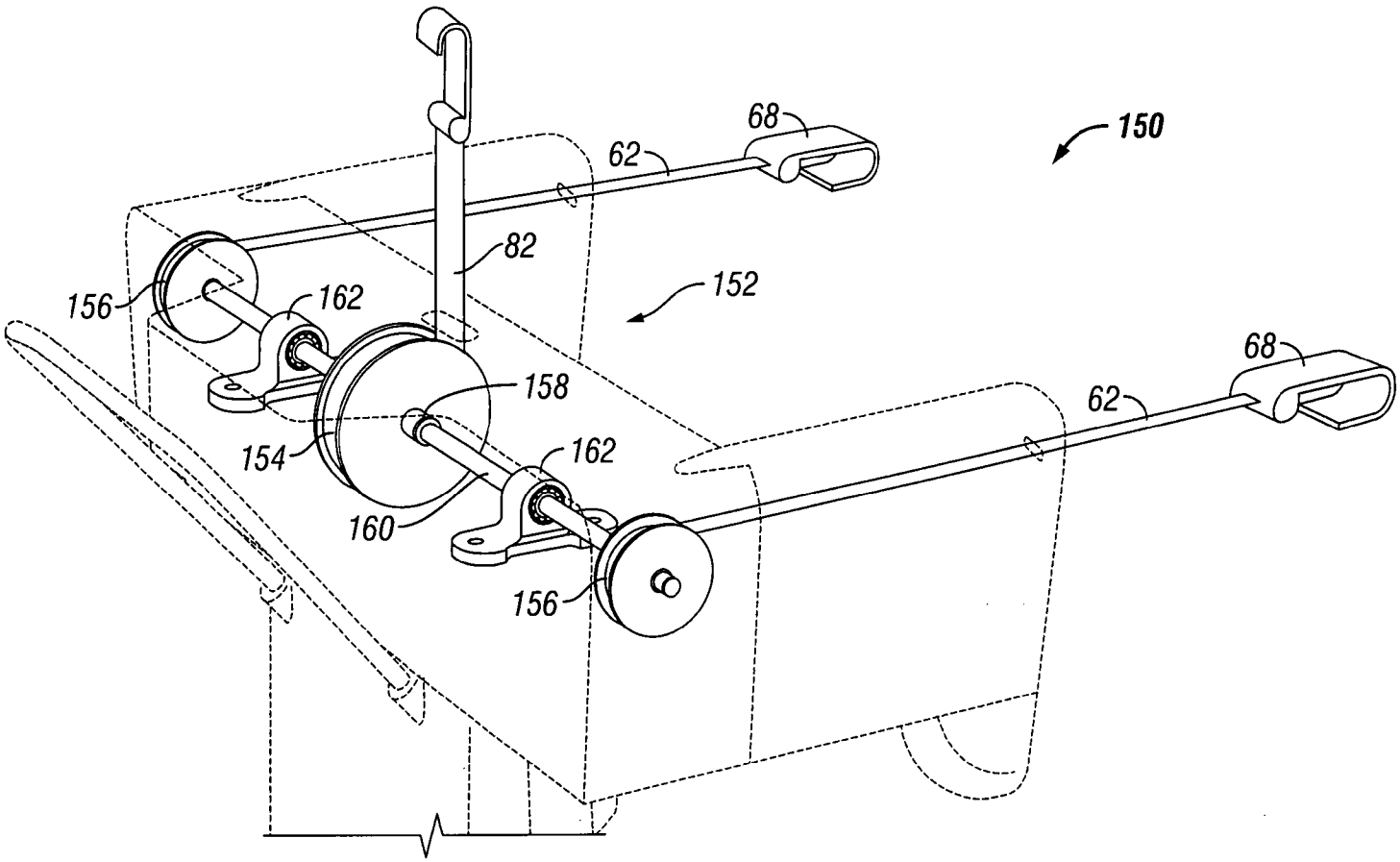
FIG. 7 is a fragmentary illustration of an alternative embodiment showing a simplified drive system.

In order to reduce cost, there has been provided a modified LTA 150 having simplified drive 152, shown in FIG. 7, that preserves most of the functionality of the LTA while dramatically reducing the number of components required. In the simplified embodiment, the drive 152 is reduced to three pulleys, including a main drive pulley 154 and a pair of output drive pulleys 156, a slip clutch 158, a shaft 160 and a pair of support bearings 162. The arrangement eliminates a number of the parts in the arrangement of FIG. 4.

In the simplified drive 152, the transmission 38 (FIG. 4) is eliminated. Accordingly, the main drive pulley 154 is enlarged in order to compensate for the gear reduction previously provided by the transmission 38. The shaft 160 connects all the components and a single slip clutch 158 is secured in the hub of the main drive pulley 154 as shown. The single slip clutch 158 replaces the paired slip clutches 50 in the more complex arrangement. Manual clutches 56, one-way bearing 146 and retractor mechanism 48 are also eliminated. The draw sheet clamps 68 are weighted. The operation of the simplified drive is discussed below.

According to the invention, the LTA 150 with the simplified drive is positioned as previously described. In the start condition the two draw sheet straps initially run down the front of the LTA with the weighted hooks 68 resting on the floor. At this stage the input strap 82 is fully wound onto the main drive pulley 154. To facilitate a transfer the two front straps 62 are picked up and attached to a draw sheet beneath the patient. The input strap 82 is then attached to a ceiling lift 90. The ceiling lift 90 is then energized, such that the LTA input strap 82 is pulled upwards. This results in rotation of all three pulleys and lateral movement of the patient. Once the transfer is complete the front strap hooks 68 are released from the draw sheet and allowed to hang in front of the LTA. The effect of gravity on the weighted strap hooks in conjunction with a reversal of ceiling lift motion (downwards) will result in a return to the initial start configuration.

We claim:

1. Apparatus for transferring a patient on a draw sheet from a first horizontal support to a second horizontal support positionable laterally adjacent to the first support in a facility equipped with an overhead motorized ceiling lift having a retractable lifting strap powered by the ceiling lift when actuated comprising:

a base being positionable in use intermediate the ceiling lift and immediately, laterally-adjacent to the second support and remote from the first support;

a pair of retractable draw straps secured to the base and being extendable across the second support for engaging the draw sheet on the first support;

a drive assembly having output ends positionable axially of the base and parallel to the second support and near the ends of the second support when in use, said drive assembly engaging the draw straps and having an input for engaging the lifting strap of the overhead lift to be powered thereby when activated, said input operable by retraction of the lifting strap of the overhead lift for causing the draw straps to be retracted, and to thereby move the draw sheet and patient laterally from the first support to the second support when the lifting strap is retracted.

2. The apparatus of claim 1 wherein each output end includes an output pulley for engaging the draw straps.

3. The apparatus of claim 1 wherein the drive assembly includes a transmission having a 2:1 gearbox for doubling the input.

4. The apparatus of claim 1 wherein each output includes a releasable clutch for releasing the retracted draw straps for engaging the draw sheet.

5. The apparatus of claim 1 wherein the drive assembly is powered by the ceiling lift.

6. The apparatus of claim 1 wherein the base is height adjustable.

7. The apparatus of claim 1 wherein the base includes lockable casters for selectively positioning the base securely with respect to the first and second supports.

8. The apparatus of claim 1 wherein the input comprises a pulley for engaging the lifting strap.

9. The apparatus of claim 1 further including a foot actuated pump for lifting the base to a selected height position.

10. The apparatus of claim 9 wherein the base includes means for releasing the base for lowering the base to a selected height.

11. The apparatus of claim 1 including a pair of parallel bearing arms extending from ends of the base for engaging the second support near the ends.

12. The apparatus of claim 1 further including a manual crank for engaging the drive assembly.

13. The apparatus of claim 1 including a manual clutch for disengaging the drive assembly from the output in at least one direction.

14. An accessory for use with powered equipment for transferring a patient on a draw sheet from a first horizontal support to a second horizontal support positionable laterally adjacent the first support comprising:

a base having a central vertical axis;

a pair of retractable straps secured to the base and being extendable in a horizontal plane perpendicular to the central axis;

a drive strap secured to the base being extendable therefrom, said drive strap having a free end for engaging the powered equipment for being extended thereby;

a drive assembly having output ends positioned in the plane, each output end of the drive assembly engaging a corresponding one of the straps, said drive assembly having an input, said input operable by retraction of the drive strap for causing the draw straps to retract and thereby move the draw sheet and patient from the first support to the second support when the drive strap is extended by the powered equipment.

15. A method for laterally transferring a patient on a draw sheet from a first horizontal support to an adjacent second horizontal support in a facility equipped with an over head patient lift having a retractable lifting strap comprising the steps of:

positioning the first and second supports side by side adjacent to each other;

positioning a base adjacent to the second support and remote from the first support;

employing a drive assembly mounted in the base having output releasable draw straps and an input drive;

releasing the draw straps and engaging ends of the draw sheet;

positioning the patient lift above the base and engaging the lifting strap with the input drive of the drive assembly;

activating the patient lift for retracting the lifting strap and driving the drive assembly to cause the draw straps to retract and thereby transfer the patient on the draw sheet from the first support to the second support.

16. Apparatus for transferring a patient on a draw sheet from a first horizontal support to an second horizontal support adjacent the first support in a facility equipped with an overhead motorized ceiling lift having a retractable lifting strap comprising:

a height adjustable base being positioned in use adjacent to the second support and remote from the first support;

a pair of retractable draw straps secured to the base and being extendable across the second support for engaging the draw sheet;

a drive assembly having output ends positioned axially of the base and parallel to the second support and near the ends of the second support when in use, said drive assembly engaging respective ones of the draw straps and having an input for engaging the lifting strap of the overhead lift, said input operable by retraction of the lifting strap for causing the draw straps to retract and thereby move the draw sheet and patient from the first support to the second support when the lifting strap is retracted.

* * * * *